US012098904B2

(12) United States Patent
Brown et al.

(10) Patent No.: US 12,098,904 B2
(45) Date of Patent: Sep. 24, 2024

(54) PROJECTILE-PROPELLING EXPLOSIVE STRUCTURE

(71) Applicant: River Front Services, Inc., Chantilly, VA (US)

(72) Inventors: Anthony Miles Brown, Sneads Ferry, NC (US); Donald Ray Brown, Oakton, VA (US); Darby William McDermott-Brown, Oakton, VA (US)

(73) Assignee: River Front Services, Inc., Chantilly, VA (US)

( * ) Notice: Subject to any disclaimer, the term of this patent is extended or adjusted under 35 U.S.C. 154(b) by 0 days.

(21) Appl. No.: 18/074,210

(22) Filed: Dec. 2, 2022

(65) Prior Publication Data

US 2023/0296351 A1 Sep. 21, 2023

Related U.S. Application Data

(60) Provisional application No. 63/285,744, filed on Dec. 3, 2021.

(51) Int. Cl.
*F41F 1/00* (2006.01)

(52) U.S. Cl.
CPC ..... *F41F 1/00* (2013.01)

(58) Field of Classification Search
CPC . F42B 3/093; F42D 1/04; F42D 1/043; C06C 5/04; C06C 5/06
USPC ..... 102/275.1, 275.8
See application file for complete search history.

(56) References Cited

U.S. PATENT DOCUMENTS

| | | | |
|---|---|---|---|
| 2,687,866 A | 8/1954 | Johnson | |
| 3,169,478 A | 2/1965 | Schaaf | |
| 3,320,883 A | 5/1967 | Martin | |
| 3,327,979 A | 6/1967 | Akio | |
| 3,374,737 A | 3/1968 | Pike | |
| 3,431,574 A | 3/1969 | Mathieu | |

(Continued)

FOREIGN PATENT DOCUMENTS

| | | | |
|---|---|---|---|
| EP | 0500512 A2 * | 8/1992 | ..... F42D 1/043 |
| EP | 0357658 B1 | 2/1994 | |

(Continued)

OTHER PUBLICATIONS

"International Preliminary Report on Patentability issued in International Patent Application No. PCT/US2019/039991 filed Jun. 28, 2019", mailed Jan. 7, 2021, 8 pages.

(Continued)

*Primary Examiner* — Bret Hayes
(74) *Attorney, Agent, or Firm* — Johnson, Marcou, Isaacs & Nix, LLC

(57) ABSTRACT

A deployable, linear explosive structure includes a split tube, an explosive coupled to the split tube, and a fragmentable or non-fragmentable projectile disposed with respect to the explosive. The split tube can be rolled into a non-deployed state in which the split tube has a flat, rolled profile. The split tube also can be deployed from the non-deployed state to a deployed state in which the split tube is extended along its length and has a curved cross-section along its length. The split tube provides support of the explosive structure in the deployed state. The split tube also provides smaller storage and transportation volume for the explosive structure when rolled in the non-deployed state.

22 Claims, 11 Drawing Sheets

(56) References Cited

U.S. PATENT DOCUMENTS

| | | | | |
|---|---|---|---|---|
| 3,782,284 | A | 1/1974 | Gibb | |
| 4,015,506 | A | 4/1977 | Musgrave | |
| 4,408,535 | A | 10/1983 | Alford | |
| 4,693,181 | A * | 9/1987 | Dadley | F42B 3/28 102/307 |
| 4,813,358 | A | 3/1989 | Roberts | |
| 4,856,430 | A | 8/1989 | Gibb | |
| 4,945,835 | A * | 8/1990 | Gunter | F42B 12/10 102/476 |
| 5,001,981 | A * | 3/1991 | Shaw | F42D 1/04 102/275.1 |
| 5,020,435 | A | 6/1991 | Cawte | |
| 7,802,509 | B2 | 9/2010 | Wall | |
| 7,819,063 | B1 | 10/2010 | Lehman | |
| 7,926,423 | B2 | 4/2011 | Rickman | |
| 8,006,621 | B1 | 8/2011 | Cherry | |
| 8,267,013 | B2 | 9/2012 | Moore | |
| 8,826,821 | B2 | 9/2014 | Martin | |
| 8,887,609 | B1 * | 11/2014 | Cherry | F42B 1/028 86/50 |
| 8,904,937 | B2 | 12/2014 | Mangolds | |
| 9,909,035 | B1 | 3/2018 | Caldeira | |
| 2001/0055540 | A1 | 12/2001 | Bonamarte | |
| 2006/0201373 | A1 * | 9/2006 | Sammons | C06C 5/04 102/476 |
| 2011/0072956 | A1 | 3/2011 | Wall | |
| 2015/0184799 | A1 | 7/2015 | Whitney | |
| 2016/0226126 | A1 | 8/2016 | Daton-Lovett | |
| 2016/0286016 | A1 | 9/2016 | Lee | |
| 2018/0128419 | A1 | 5/2018 | Brown | |
| 2019/0103650 | A1 | 4/2019 | Daton-Lovett | |
| 2020/0002242 | A1 | 1/2020 | Brown | |
| 2020/0132247 | A1 | 4/2020 | Brown | |

FOREIGN PATENT DOCUMENTS

| | | | |
|---|---|---|---|
| EP | 3538837 | A1 | 9/2019 |
| EP | 3673227 | A2 | 7/2020 |
| FR | 2217659 | A1 | 9/1974 |
| GB | 1415204 | A | 11/1975 |
| WO | 2018089530 | A1 | 5/2018 |
| WO | 2020055500 | A2 | 3/2020 |

OTHER PUBLICATIONS

"International Search Report and Written Opinion issued in International Patent Application No. PCT/US2017/060685 filed Nov. 8, 2017", mailed Jan. 22, 2018, 9 pages.

"International Search Report and Written Opinion issued in International Patent Application No. PCT/US2019/039991 filed Jun. 28, 2019", mailed Jun. 8, 2020, 16 pages.

"Office Action issued in U.S. Appl. No. 16/457,742, filed Jun. 28, 2019", mailed Sep. 28, 2020.

Lou, et al., "A Combined Analytical and Experimental Study on Space Inflatable Booms", Aerospace Conference Proceedings, 2000, IEEE, Mar. 18-25, 2000 vol. 2, Mar. 18, 2000, 503-511.

"International Search Report and Written Opinion issued in Patent Application No. PCT/US2022/051689 filed Dec. 2, 2022", mailed Mar. 14, 2024, 51 pages.

* cited by examiner

200a

200b

400

500

100

100

PROJECTILE-PROPELLING EXPLOSIVE STRUCTURE

CROSS REFERENCE TO RELATED APPLICATIONS

This application claims priority to U.S. Provisional Patent Application No. 63/285,744 filed Dec. 3, 2021 and titled "Explosive Structure." The entire contents of the above-identified priority application are hereby fully incorporated herein by reference.

TECHNICAL FIELD

The technology disclosed herein relates to an explosive structure, and, more particularly, to a deployable explosive structure that propels a projectile in a directed action when detonated.

BACKGROUND

Conventional explosive charges used to clear obstacles are bulky. For example, a conventional pole charge is formed from one or more pipe sections, where at least one of the pipe sections contains an explosive. Each pipe section typically is five feet long. These long sections of pipe must be transported to a desired location for detonation, and a soldier must hand-carry the pipe sections the "last mile" to the target. Such long pipe sections do not fit within standard packs, and the bulk of the pipe sections makes them difficult to carry. Additionally, conventional pole charges are limited in their application, whereby they are not suitable to be adapted to other uses, such as troop defense.

DETAILED DESCRIPTION

The technology described herein relates to a deployable, linear explosive structure that propels a projectile in a desired direction. The deployable, linear explosive structure includes a split tube, an explosive coupled to the split tube, and a fragmentable or non-fragmentable projectile disposed with respect to the explosive. The split tube can be rolled into a non-deployed state in which the split tube has a flat, rolled profile. The split tube also can be deployed from the non-deployed state to a deployed state in which the split tube is extended along its length and has a curved cross-section along its length. The split tube provides support of the explosive structure in the deployed state. The split tube also provides smaller storage and transportation volume for the explosive structure when rolled in the non-deployed state.

The explosive is coupled to either side of the split tube. For example, the explosive is coupled to an "inside" of the split tube. In this case, the explosive is disposed on the concave side of the curved cross-section of the split tube. The explosive also can be coupled to an "outside" of the split tube. In that case, the explosive is disposed on the convex side of the curved cross-section of the split tube.

The projectile is disposed on the explosive structure relative to the explosive such that detonation of the explosive propels the projectile in the desired direction. Various configurations of the projectile relative to the explosive are suitable. For example, if the explosive is disposed on the inside of the split tube, the projectile also may be disposed inside the split tube, or the projectile may be disposed on the outside of the split tube. In each case, the projectile may be coupled directly to the explosive and/or the split tube or may be suspended inside or outside of the split tube.

Detonation of the explosive propels the projectile away from the explosive in a desired direction.

Exemplary projectile-propelling explosive structures and components according to various aspects of the technology discussed herein will now be described with reference to the figures. Like numerals represent like (but not necessarily identical) elements throughout the figures.

Figure 1A:
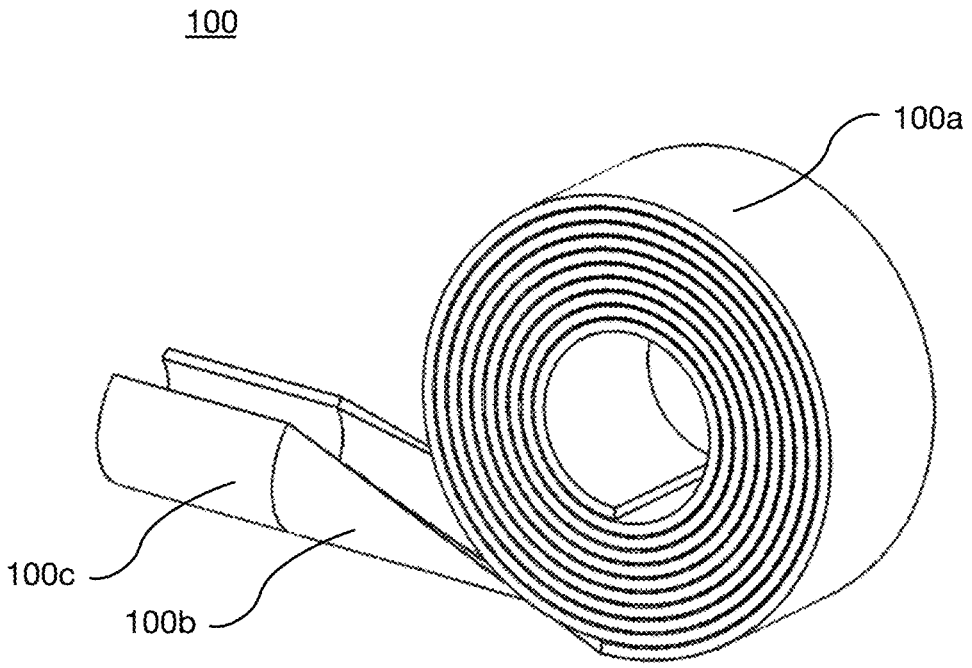
FIG. 1A is a perspective view of a split tube in a rolled, non-deployed state.
Figure 1B:
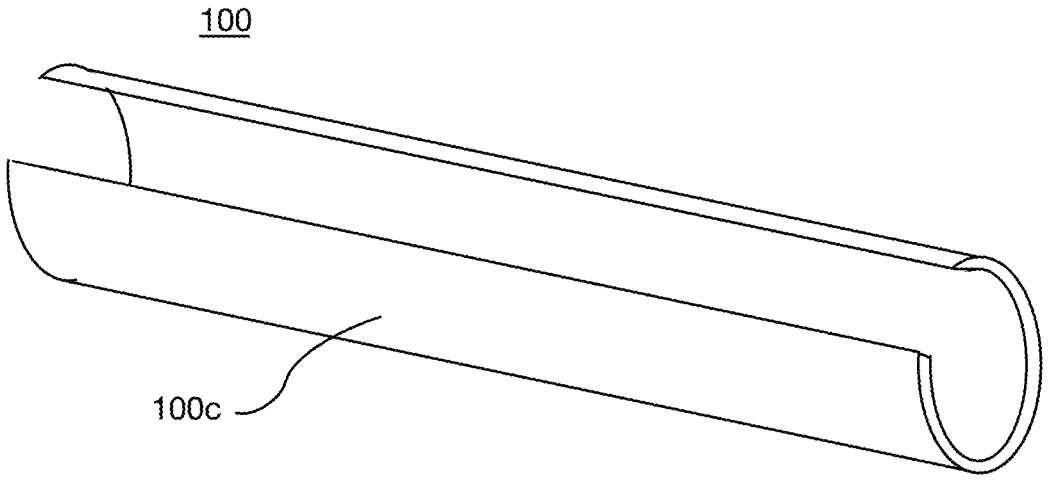
FIG. 1B is a perspective view of a split tube in the linear, deployed state.

FIGS. 1A and 1B illustrate a split tube 100 that forms part of the explosive structure described herein. FIG. 1A is a perspective view of the split tube 100 in a rolled, non-deployed state, as shown by the rolled section 100*a* of the split tube 100. The rolled, non-deployed state 100*a* of the split tube 100 has a flat profile. As shown in FIG. 1A, the split tube comprises a flat, rolled profile 100*a* in the undeployed state, and a curved, linear profile 100*c* in the deployed state, separated by a transition zone 100*b* where the split tube gradually transitions from the rolled, undeployed state 100*a* to the linear, deployed state 100*c*. When fully undeployed, substantially all of the split tube comprises the rolled, flat profile 100*a*. When fully deployed, substantially all of the split tube comprises the curved, linear profile 100*c*.

FIG. 1B is a perspective view of a split tube 100 in the linear, deployed state 100*c*. The linear, deployed state 100*c* of the split tube 100 has a curved, linear profile.

The split tube 100 may be any suitable tubular structure. A "split tube" is a tubular structure that is not a completed tube because edges of the tubular structure are not connected. As shown in FIGS. 1A and 1B, the split tube 100 has a cross-section comprising approximately eighty percent of a full circle or other tubular structure. Any suitable diameter of the split tube 100 may be utilized to provide desired support for an explosive and a projectile when in the linear, deployed state 100*c*. For example, more or less of a diameter may be utilized as desired. The split tube can comprise more than eighty percent of a full tube, and may comprise more than 100% of a full tube. For more than 100% of a full tube, the edges 100*d* of the split tube 100 will overlap to complete a full tubular shape. The split tube 100 also can comprise less than eighty percent of a full tube, even as little as 10% of a full tube, as long as the linear, deployed shape has a curved cross-sectional profile.

The split tube 100 may be formed of any suitable material, such as metal, plastics, composites, or any other suitable material or combinations thereof.

The split tube 100 may be, for example, a bistable structural tape comprising an undeployed state 100*a* and a deployed state 100*c*. The bistable tape has a rolled, flat transverse profile in the undeployed state 100*a*, and the bistable tape has a linear, curved profile in the deployed state 100*c*. The bistable tape is stable in the undeployed state 100*a* and in the deployed state 100*c*, and the bistable tape is unstable when between states such that transitioning one end of the bistable tape from the rolled shape to the linear shape places the bistable tape in an unstable state causing the bistable tape to self-deploy to the deployed state 100*c*.

For a split tube 100 that is a bistable tape, the bistable tape can be made from a carbon fiber composite, fiberglass, or other suitable material or combinations thereof. The two states in which the bistable tape is stable are: (a) when substantially the entire bistable tape is disposed in an Archimedean roll (i.e., the undeployed state 100*a*) and (*b*) when substantially the entire bistable tape extends linearly (i.e., the deployed state 100*c*). If the bistable tape is between these two stable states, (i.e., a portion of the tape is rolled up and a portion of the tape extends linearly or is partially deployed), the energy stored in the tape is automatically applied to transition the tape towards one of the two stable states. Since one of the two stable states is the undeployed state 100*a* in which the bistable tape is disposed in an Archimedean spiral, this use of a bistable tape may avoid the need for a restraining device to maintain the undeployed state 100*a*. To elaborate, one of the stable states of the bistable tape is the Archimedean spiral or roll. As such, the bistable tape will remain in the Archimedean spiral or roll until action is taken to deploy the bistable tape. Specifically, once a portion of the bistable tape is deployed by moving the outer end of the tape away from the roll so that the portion of the tape extends linearly and adopts a curved profile, the remainder of the bistable tape will self-deploy to adopt the fully deployed configuration shown in FIG. 1B.

Figure 10A:
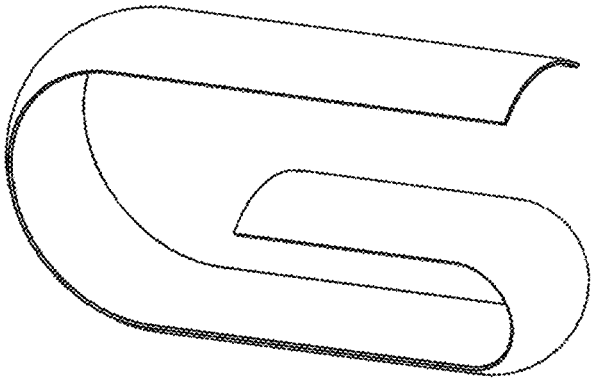
FIG. 10A is a perspective view of a split tube that is rolled in a flattened roll as its undeployed state.
Figure 10B:
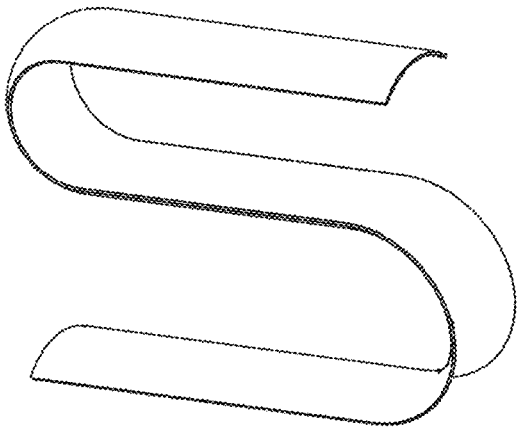
FIG. 10B is a perspective view of a split tube that is folded in a serpentine pattern as its undeployed state.

A bistable tape also can be used when the undeployed state 100*a* is a "flattened" roll or is folded in a serpentine pattern, as depicted in FIGS. 10A and 10B, respectively. However, a restraining device may be needed to maintain the bistable tape in an undeployed state that is a flattened roll or a serpentine fold. FIG. 10A is a perspective view of a split tube 100 that is rolled in a flattened roll as its undeployed state. FIG. 10B is a perspective view of a split tube 100 that is folded in a serpentine pattern as its undeployed state. In any of these undeployed states, releasing the potential energy of the bistable tape will cause the bistable tape to self-deploy into the linear, deployed state. As shown in undeployed states of FIGS. 10A and 10B, a portion of the split tube 100 is already transitioned to the deployed state. Accordingly, when a restraint is removed from the split tube 100, the split tube 100 will fully self-deploy to the linear, deployed state.

In other examples, the split tube 100 may be a carpenter's tape without the properties of a bi-stable structural state. In the deployed state 100*c*, the carpenter's tape extends linearly between the ends of the tape and has a transverse curve over the deployed length of the tape. That configuration gives the deployed tape beam-like characteristics, which allow the tape to be supported at one end and to extend a considerable distance to a free or unsupported end. A carpenter's tape also can be rolled from one end to the other end (producing an Archimedean spiral roll) with the rolling resulting in the transverse curve in the tape being removed as the rolling operation progresses, thereby producing a flat, rolled tape. A carpenter's tape can also be folded so as form a "flattened" roll or folded to follow a serpentine path. In either case, linear sections of tape, which each have the noted transverse curve, are separated from one another by a curved section that lacks the transverse curve. In the undeployed state 100*a*, the carpenter's tape stores potential energy that, if applied, causes the tape to transition from the undeployed state 100*a* (or from the flattened roll or folded serpentine pattern undeployed states) to or towards the deployed state 100*c*. In other words, the carpenter's tape is capable of self-deployment. If the carpenter's tape is a metal carpenter's tape (such as is found in a carpenter's measuring tape), the explosive structure comprising the carpenter's tape may use a restraint to hold the carpenter's tape in the undeployed state 100*a*, regardless of whether the tape in the undeployed state 100*a* is disposed in an Archimedean spiral, a "flattened" roll, or a folded serpentine pattern. Carpenter's tapes are typically formed from metal but may be formed from any suitable material.

A split tube 100 comprising a tape that is not bistable and is made from carbon fiber composite, fiberglass, or other suitable material can also be employed. The use of such a tape may utilize, like the carpenter's tape, a restraining mechanism to hold the tape in the undeployed state 100*a*.

When using a carpenter's-type tape, deployment involves removing the restraining mechanism that is holding the structure in the undeployed state 100*a* and allowing the carpenter's tape to unroll to the linear, deployed state 100*c*. In contrast, when using a bistable tape and the bistable tape is in the rolled, undeployed state 100*a*, the user displaces the outer end of the bistable tape away from the remainder of the bistable tape, thereby placing a small portion of the bistable tape in the deployed state 100*c*. Once a sufficient amount of the bistable tape has been placed in the deployed state 100*c*, the bistable tape will self-deploy towards the deployed state 100*c*.

Figure 2A:
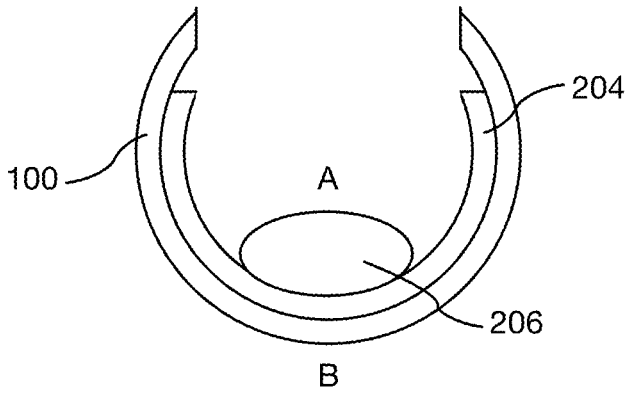
FIG. 2A is a cross-sectional view of an explosive structure comprising an explosive and a projectile disposed on and inside of a split tube.
Figure 2B:
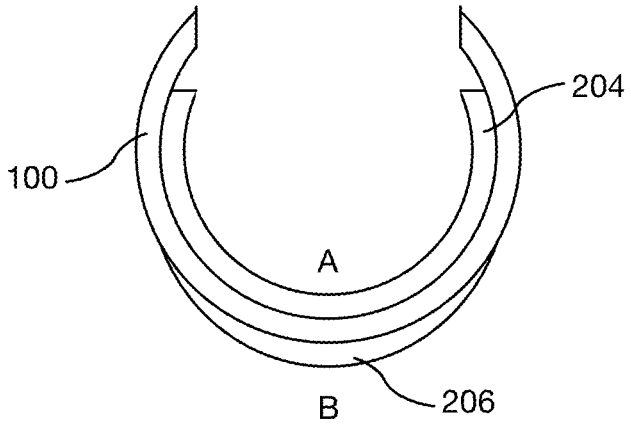
FIG. 2B is a cross-sectional view of an explosive structure comprising an explosive disposed on the inside of the split tube and a projectile disposed on an outside of the split tube.
Figure 2C:
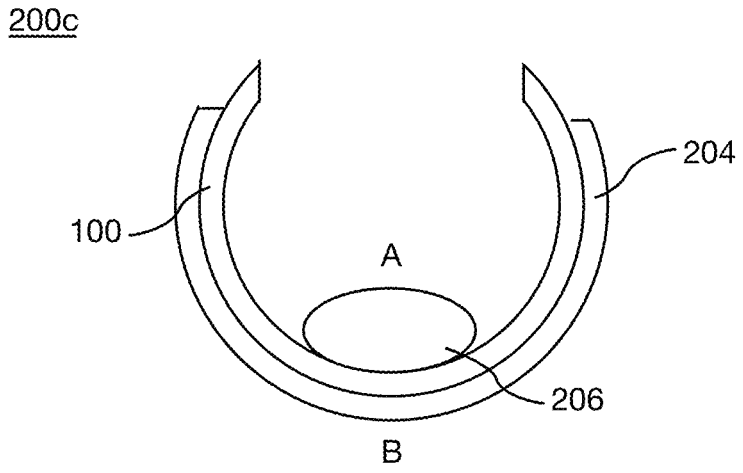
FIG. 2C is a cross-sectional view of an explosive structure comprising an explosive disposed on the outside of the split tube and a projectile disposed on the inside of the split tube.
Figure 2D:
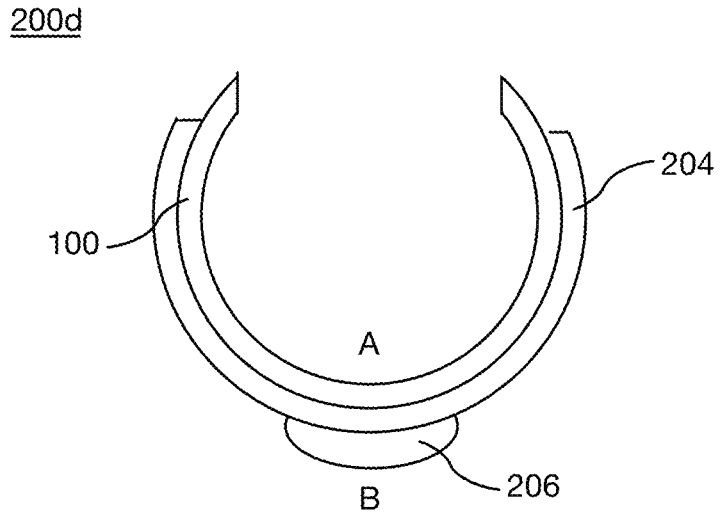
FIG. 2D is a cross-sectional view of an explosive structure comprising an explosive and a projectile disposed on the outside of the split tube.

FIGS. 2A-2D depict projectile-propelling explosive structures 200*a*-200*d* incorporating the split tube 100 described with reference to FIGS. 1A and 1B. FIG. 2A is a cross-sectional view of an explosive structure 200*a* comprising an explosive 204 and a projectile 206 disposed on and inside A of the split tube 100. FIG. 2B is a cross-sectional view of an explosive structure 200*b* comprising an explosive 204 disposed on the inside A of the split tube 100 and a projectile 206 disposed on an outside B of the split tube 100. FIG. 2C is a cross-sectional view of an explosive structure 200*c* comprising an explosive 204 disposed on the outside B of the split tube 100 and a projectile 206 disposed on the inside A of the split tube 100. FIG. 2D is a cross-sectional view of an explosive structure 200*d* comprising an explosive 204 and a projectile 206 disposed on the outside B of the split tube 100.

As shown in FIGS. 2A-2D, the explosive structures 200*a*-200*d* comprise a split tube 100 (illustrated in the deployed position), an explosive 204 attached to the split tube 100, and a projectile 206 disposed relative to the explosive 204.

The explosive 204 may be any suitable explosive, for example, a sheet explosive, a cord explosive, a flexible explosive, a malleable explosive, or any suitable explosive material. It should be appreciated that, while each of explosive structures 200*a*-200*d* illustrates the explosive 204 as being a sheet-type explosive 204, other embodiments may employ multiple strands of explosive 204 or may employ a different type of flexible explosive 204, such as detonating cord or other suitable explosive 204. One example of a sheet-type explosive is DETASHEET® explosive. The sheet-type explosive facilitates the flat shape of the split tube 100 when the explosive structure is in the rolled, undeployed state 100*a*. Using bulkier, non-uniform, and/or non-flat explosives 204 may result in a less uniformly flat shape of the split tube 100 of the explosive structure in the rolled, undeployed state 100*a*. However, such explosives are still suitable for the explosive structures described herein.

As shown in FIGS. 2A and 2D, the projectile 206 is disposed adjacent to the explosive 204. However, the projectile 206 may be disposed on a side of the split tube 100 that is opposite to the explosive 204, as shown in FIGS. 2B and 2C. Additionally, the explosive 204 may be disposed on either side of the split tube 100, as depicted in FIGS. 2A-2D.

The projectile 206 may be laid on the explosive 204. If desired, the projectile 206 may be adhered to the explosive structures 200*a*-200*d*, for example, using an adhesive, such as a spray adhesive, tape, two-sided tape, or any suitable adhesive. The projectile 206 also may be coupled to the structure via mechanical devices, such as zip ties, string, paracord, rope, hooks, or other suitable device. The projectile also can be formed integrally with the split tube 100 or the explosive 204.

The projectile 206 also may be laid loosely on the split tube 100 and/or the explosive 204. In this case, the walls creating the inside of the split tube 100 hold the loosely laid projectile 206 in place. However, the projectile 206 also can be laid loosely on the outside of the split tube 100.

Additionally, the projectile 206 may be suspended in proximity to the explosive 204 such that the projectile 206 does not touch the explosive 204 or the split tube 100 along a length of the projectile 206, or such that only a portion of a length of the projectile 206 touches the explosive 204 or the split tube 100. In one such example, bungee cords, or other suitable fastener cords, such as string, rope, wire, or paracord, are attached to each end of the projectile 206. Each fastener cord has a hook or other suitable connector attached to an end of the fastener cord that is opposite to the end of the fastener cord attached to the projectile 206. Then, the connectors are attached to opposite ends of the split tube 100 to suspend the projectile 206 between the sides of the split tube 100 and along a length of the split tube 100. The connectors can be attached near the open edges of the split tube 100 to increase the height of the projectile 206 above the explosive 204. The position of the connectors on the ends of the split tube 100 can be adjusted around the circumference of the split tube 100 to control a height of the projectile 206 above the explosive 204. The split tube 100 can include the hooks and/or fastener cords attached to its ends, which may be connected directly to the projectile 206 or to the fastener cords attached to the projectile 206.

The projectile 206 can be attached to the outside of the split tube 100 using the connectors as well, in which case the projectile 206 is disposed along an exterior length of the split tube 100.

The explosive 204 may be adhered to the explosive structures 200*a*-200*d*, for example, using an adhesive, such as a spray adhesive, tape, two-sided tape, or any suitable adhesive. The explosive 204 also may be coupled to the structure via mechanical devices, such as zip ties, string, paracord, rope, hooks, or other suitable device. The explosive 204 also can be formed integrally with the split tube 100 or the projectile 206. Certain explosives 204, such as sheet explosive or others, may be manufactured with an adhesive tape on at least one side of the explosive 204. In this case, the explosive 204 can be adhered to the explosive structures 200*a*-200*d* by removing a sacrificial member on the exterior of the adhesive and pressing the explosive 204 to the split tube 100 or the projectile 206.

The methods to attach the explosive 204 and/or the projectile 206 are suitable with any explosive structure described herein.

Figure 3A:
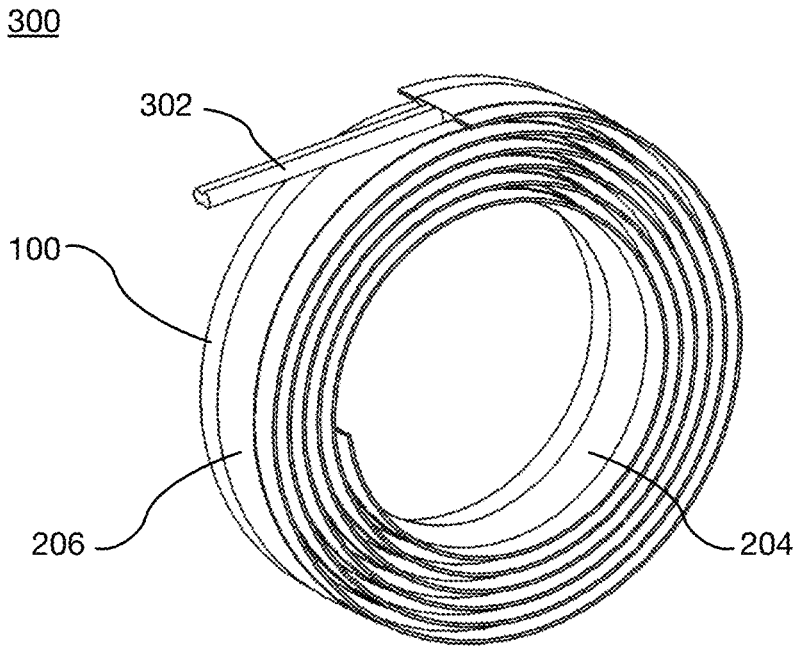
FIG. 3A is a perspective view of an explosive structure in the rolled, undeployed state.
Figure 3B:
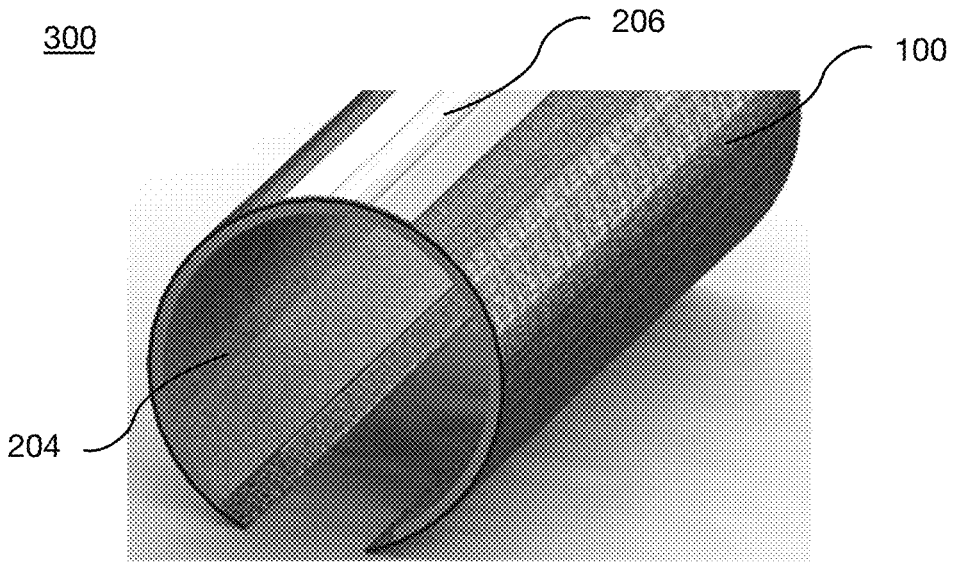
FIG. 3B is a perspective view of an explosive structure in the linear, deployed state.

FIGS. 3A and 3B depict an exemplary explosive structure 300 comprising a split tube 100, a sheet explosive 204 disposed on an inside of the split tube 100, and a projectile 206 disposed on an outside of the split tube 100. FIG. 3A is a perspective view of the explosive structure 300 in the rolled, undeployed state 100*a*. FIG. 3B is a perspective view of the explosive structure 300 in the linear, deployed state 100*c*. As shown in FIGS. 3A and 3B, the projectile 206 has a slim, flat profile, which, together with the flat profile of the sheet explosive 204, facilitates the flat shape of the split tube 100 when the explosive structure 300 is in the rolled, undeployed state 100*a*.

As shown in FIG. 3A, a primer, such as a pigtail 302, may be attached to the explosive 204 to initiate detonation of the explosive 204 in any of the explosive structures described herein. The pigtail 302 can comprise a length of detonating cord, explosive, or other detonating material coupled to the explosive 204 on one end and to blasting caps (not depicted) on an opposite end. The blasting caps can be initiated by any suitable means, which initiates the detonating material, which initiates the explosive 204 in the explosive structure. An exemplary pigtail 302 is illustrated in FIG. 3A.

Figure 3C:
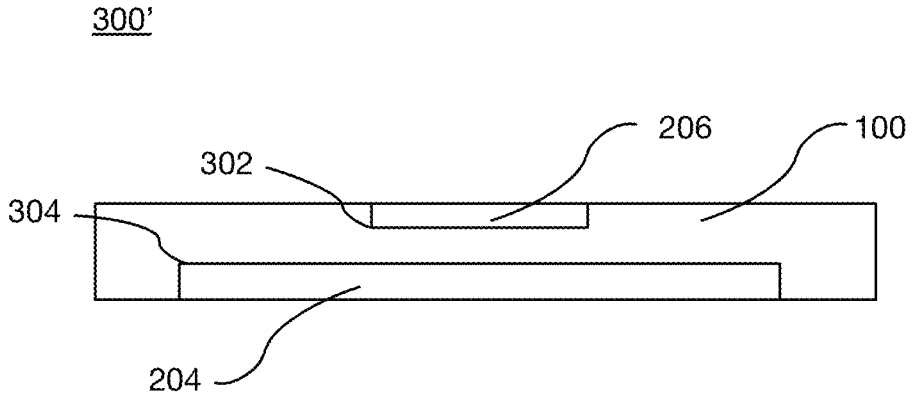
FIG. 3C is a cross-sectional view of an explosive structure comprising a split tube profile that envelops the explosive and the projectile to provide an overall flat profile for the explosive structure.

FIG. 3C is a cross-sectional view of an explosive structure 300' comprising a split tube 100 profile that envelops the explosive 204 and the projectile 206 on at least three sides to provide an overall flat profile for the explosive structure. The explosive structure 300' is depicted in FIG. 3C in the rolled, undeployed state 100*a*. The split tube 100 is provided with a first channel 302 in which the projectile 206 is disposed and a second channel 304 in which the explosive 204 is disposed. In this manner, a thickness of the explosive structure 300' is controlled to a desired thickness. If the projectile 206 and the explosive 204 do not protrude past the channels 302, 304, respectively, then the thickness of the explosive structure 300' is not more than the thickness of the split tube 100. If the projectile 206 and/or the explosive 204 extend past the channels 302, 304, respectively, then the thickness of the explosive structure 300' is more than the thickness of the split tube 100; however, the thickness is less than if the channels 302, 304 were not provided. The overall flat profile of the explosive structure 300' further facilitates the flat shape of the split tube 100 when the explosive structure is in the rolled, undeployed state 100*a*.

The projectile 206 and the explosive 204 can be added to the split tube 100 to create the explosive structures 300, 300'. Alternatively, the split tube 100 can be manufactured to include the projectile 206, and the explosive 204 can be added to the split tube 100/projectile 206 combination to create the explosive structures 300, 300'. As shown in FIGS. 3A-3C, the projectile 206 is a metal band. However, any suitable projectile 206 may be utilized.

In each case, a flatter profile of the explosive structure allows the explosive structure to better maintain the rolled, undeployed state 100*a*. For example, a flatter profile helps a split tube 100 formed from a bistable tape to maintain its stable position in the rolled, undeployed state 100*a* without restraint or with less restraint.

The rolled, undeployed state 100*a* and the linear, deployed state 100*c* apply to the explosive structures described herein. The split tube 100 combined with the explosive 204 and/or the projectile 206 maintains the characteristics of the split tube 100 discussed previously. Bulkier explosives 204 may affect the ability of the split tube 100 to roll into a flat, undeployed state. When bulkier explosives 204 are used in the explosive structures described herein, the split tube 100 may be rolled into a flattened roll as the undeployed state (as shown in FIG. 10A) or folded into a serpentine pattern as the undeployed state (as shown in FIG. 10B). These alternative undeployed states are suitable for the innovations described herein.

Figure 4:
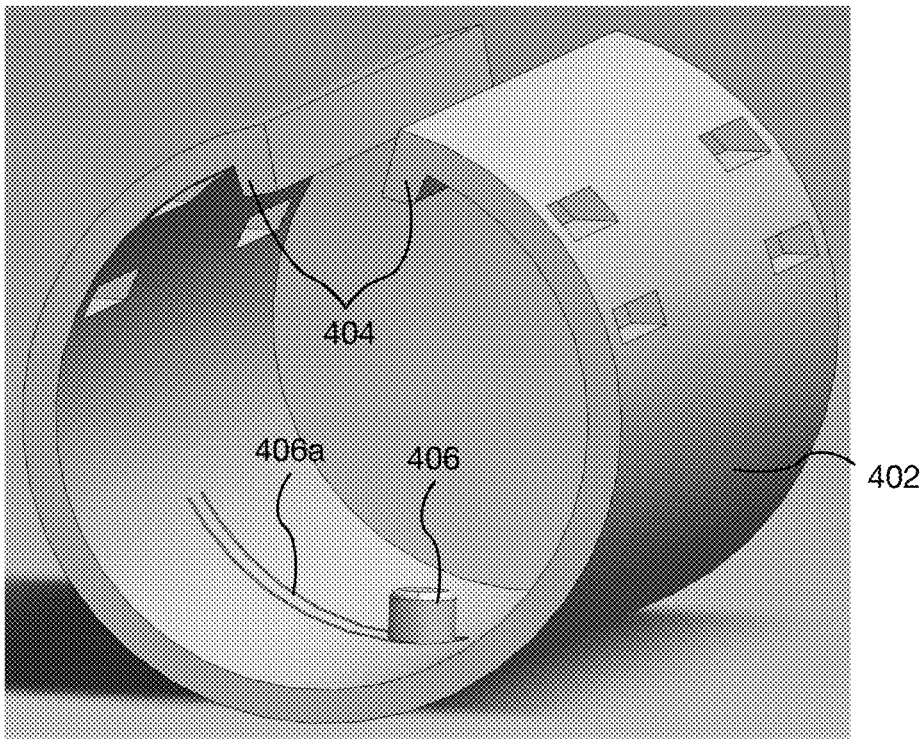
FIG. 4 is a perspective view of a straight connector for connecting two explosive structures in an end-to-end configuration.
Figure 5:
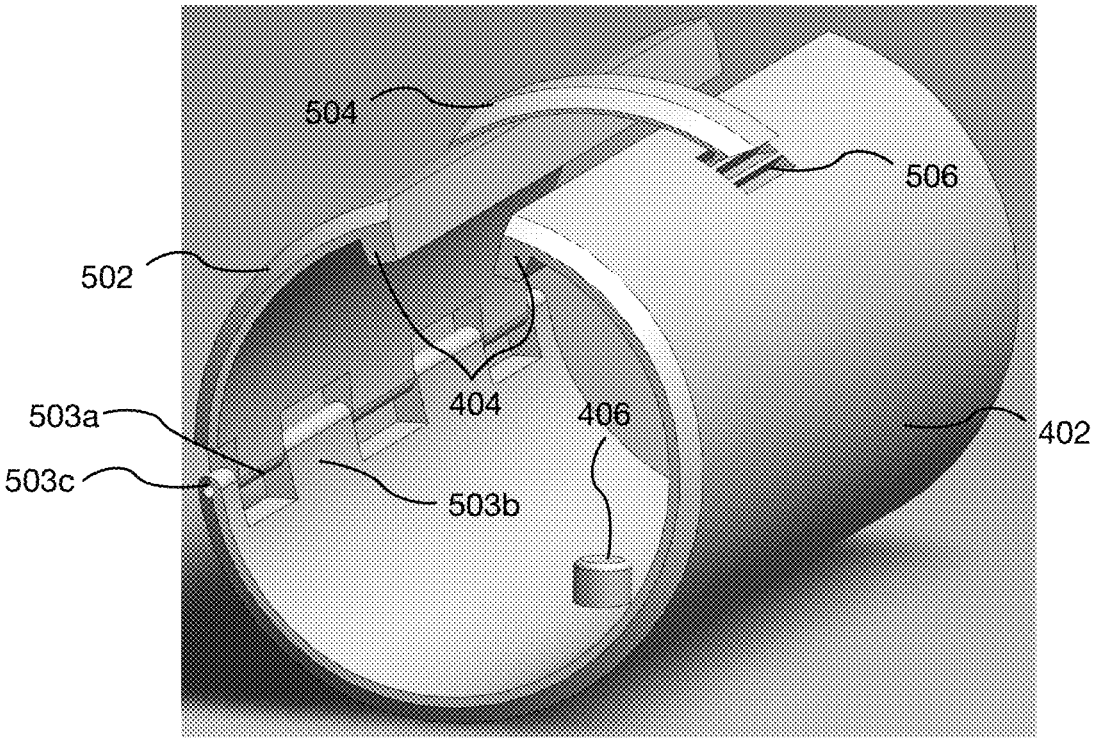
FIG. 5 is a perspective view of a hinged, straight connector for connecting two explosive structures in an end-to-end configuration.
Figure 6:
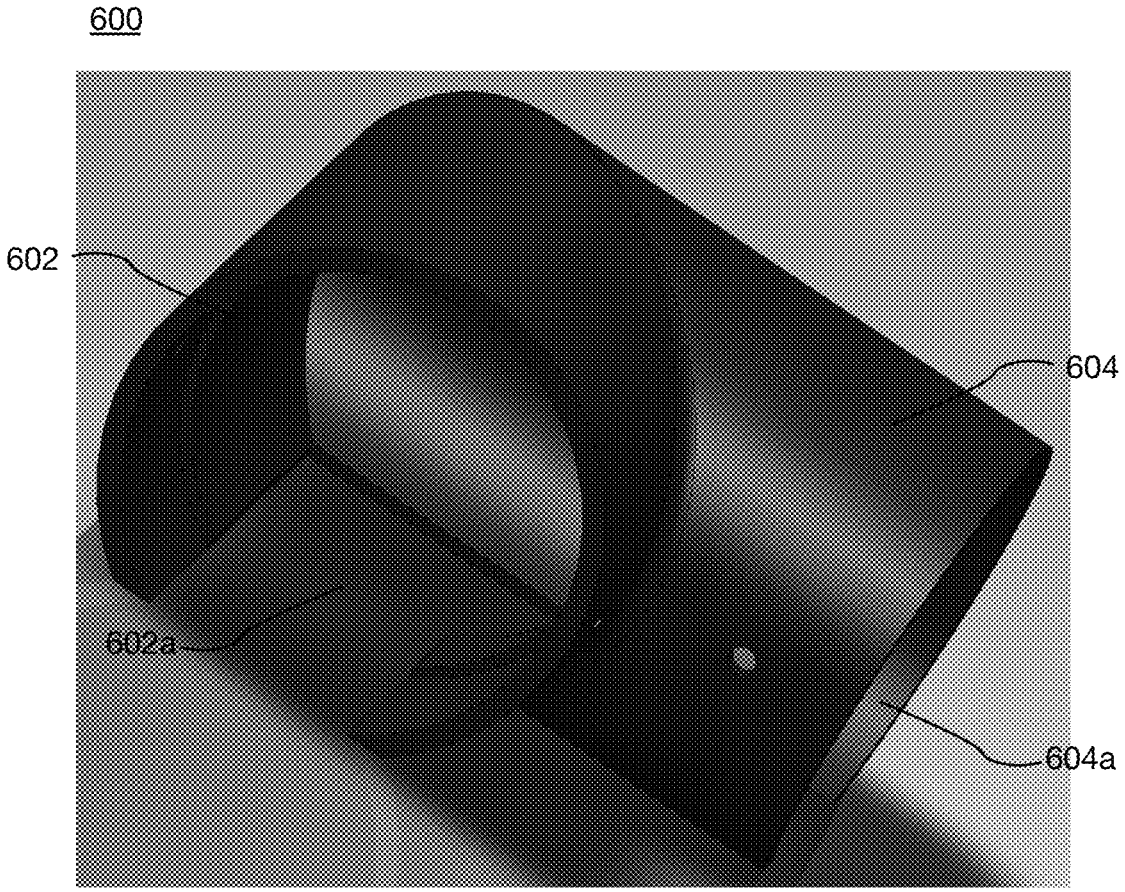
FIG. 6 is a perspective view of an angled connector for connecting two explosive structures in an angled configuration.

Multiple explosive structures as described herein may be connected together to create longer explosive structures and/or to create explosive structures having other than a straight configuration. FIGS. 4-6 depict connectors for coupling multiple explosive structures together.

FIG. 4 is a perspective view of a straight connector 400 for connecting two explosive structures in an end-to-end configuration. As shown in FIG. 4, the connector 400 comprises a tubular section 402 corresponding to the curved profile of the deployed split tube 100. Additionally, the tubular section 402 is sized corresponding to an exterior size and shape of the deployed split tube 100. The connector 400 further includes a lip 404 on one or both edges of the connector 400. The connector 400 may be flexible to snap around the ends of two split tube s 100 by pressing the connector 400 over the split tubes 100 (either individually or simultaneously) until the lip(s) 404 of the connector 400 snaps over the longitudinal edges of the split tubes 100. Alternatively, an end of one split tube 100 is inserted into an end of the connector 400, and then an end of the other split tube 100 is inserted into the other end of the connector 400.

The connector 400 also can include one or more knobs 406 on an interior of the connector 400. The knob 406 protrudes into an interior of the connector 400 and is configured to mate with a corresponding aperture near the end of the split tubes 100 inserted into the connector 400. A split tube 100 is inserted into an end of the tube connector, the knob 406 is depressed toward an exterior of the connector 400 and hinges outward. Then, the knob 406 springs into the aperture of the inserted split tube 100 when the aperture and the knob 406 are aligned. As shown in FIG. 4, the knob 406 is attached to the connecter 400 by an elongated section 406*a* in the wall of the split tube 100. The elongated section 406*a* provides a hinge arm allowing the knob 406 to be pushed outwardly and then spring back when aligned with the aperture in the split tube 100.

The knob 406 also can facilitate aligning the split tubes 100 in the connector 400 without engaging in an aperture of one or more of the split tubes 100. For example, the knob 406 can function as a stop to prevent further insertion of the split tubes 100 into the connector 400. In this manner, each split tube 100 may only be inserted into the connector 400 until an end of the split tube 100 contacts the knob 406.

FIG. 5 is a perspective view of a hinged, straight connector 500 for connecting two explosive structures in an end-to-end configuration. The connector 500 is similar to the connector 400 with the addition of a hinged door 502. The hinged door 502 includes alternating tabs 503*a* that mate with alternating tabs 503*b* in the connector 500. The alternating tabs 503*a*, 503*b* are coupled together via a hinge pin 503*c* extending through the alternating tabs 503*a*, 503*b* to secure the door 502 in a hinged relationship to the connector 500. Opening the door 502 can allow an easier snap fit or insertion of the split tubes 100 into the connector 500. Then, the door 502 is closed over the inserted split tubes 100, and a latch 504 in the door 502 engages grooves 506 on the connector 500 to latch the door 502 in a closed position. Alternatively, an end of one split tube 100 is inserted into an end of the connector 500, and then an end of the other split tube 100 is inserted into the other end of the connector 500, after which the door 502 is closed and the latch 504 is engaged.

The connectors can be shaped to form desired configurations of explosive structures. Straight connectors, as described with reference to FIGS. 4 and 5, create a straight explosive structure. Tube connectors having a 22.5-degree, 45-degree, 60-degree, 90-degree, or other angle can be used to create structures having other orientations. FIG. 6 is a perspective view of an angled connector 600 for connecting two explosive structures in an angled configuration. The angled connector 600 includes tubular sections 602, 604 with corresponding openings 602*a*, 604*a*. The tubular sections 602, 604 are connected in a 90-degree angle to create a 90-degree connector. Although depicted as a 90-degree connector in FIG. 6, the tubular sections 602, 604 may be coupled together via any desired angle, such as the angles described previously. A first explosive structure is inserted into the opening 602*a* of the angled connector 602, and a second explosive structure is inserted into the opening 604*a* of the angled connector 604. In this manner, the two explosive structures are connected in a 90-degree angle, or at any other angle corresponding to the angle of the connector 600. The angled connector also may incorporate other features discussed with regard to FIGS. 4A and 4B, such as the knob 406, lips 404, and or the hinged door 502 and latch 504, 506.

Figure 7A:
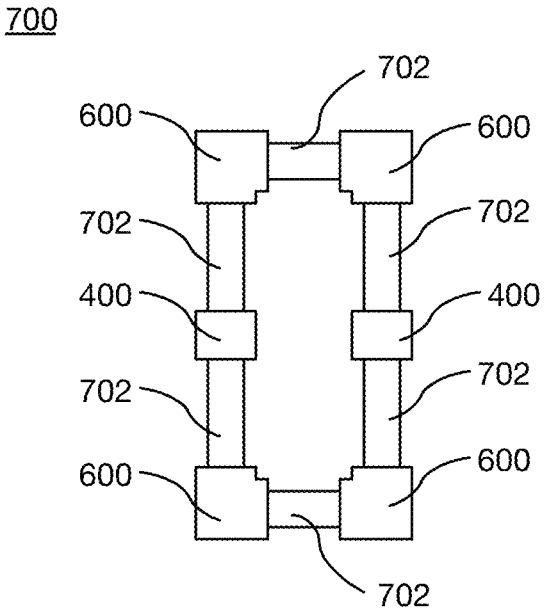
FIG. 7A is a plan view of a rectangular configuration comprising multiple explosive structures connected by multiple straight connectors and multiple angled connectors.
Figure 7B:
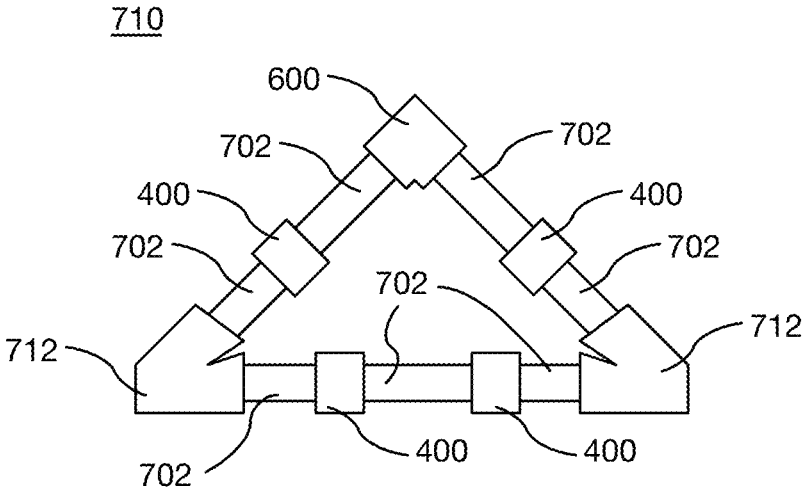
FIG. 7B illustrates a plan view of a triangular configuration comprising multiple explosive structures connected by multiple straight connectors and multiple angled connectors.

FIGS. 7A-7B are plan views of various configurations created by connecting multiple explosive structures 700 using connectors 400, 500, and/or 600. FIG. 7A is a plan view of a rectangular configuration 700 comprising multiple explosive structures 700 connected by multiple straight connectors 400 and multiple angled connectors 600 (90-degree connectors). FIG. 7B illustrates a plan view of a triangular configuration 710 comprising multiple explosive structures 700 connected by multiple straight connectors 400 and multiple angled connectors 600, 712 (a 90-degree connector and two 45-degree connectors). The explosive structures 700 may be any of the explosive structures described herein.

When multiple explosive structures are connected, the explosives 204 of each connected structure are coupled together via a length of shock tube, detonation cord, or other suitable material, such that detonation of the explosive 204 of one explosive structure will trigger detonation of the explosive 204 of the next explosive structure coupled thereto.

A nose cone can be provided and shaped to slip over the end of a deployed split tube 100 to provide a blunted end of the split tube 100 and the explosive structure. In this manner, a deployed explosive structure with a nose cone can be pushed forward into an object to be breached, or into a hole in the ground, wall, door, or other structure. The nose cone prevents snagging of the end of the explosive structure and facilitates insertion of the explosive structure.

Figure 8A:
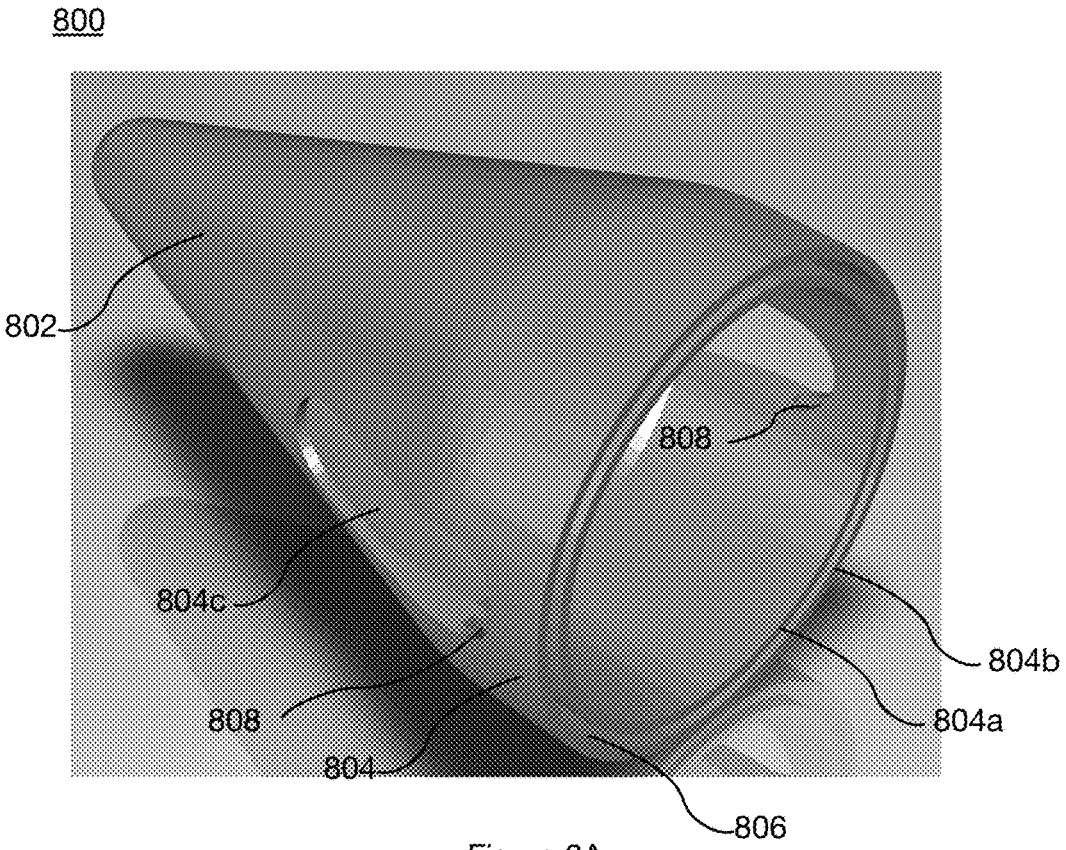
FIG. 8A is a perspective view of a nose cone for an explosive structure.
Figure 8B:
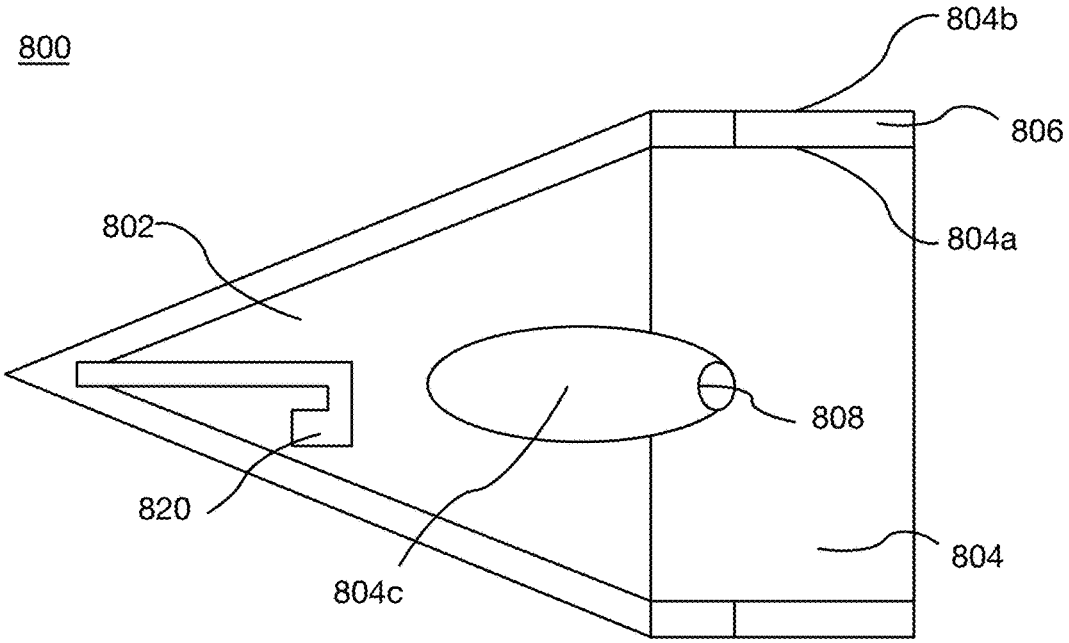
FIG. 8B is a cross-sectional view of the nose cone for an explosive structure.

FIGS. 8A and 8B depict an exemplary nose cone 800. FIG. 8A is a perspective view of the nose cone 800 for an explosive structure. FIG. 8B is a cross-sectional view of the nose cone 800 for an explosive structure. As shown in FIGS. 8A and 8B, the nose cone 800 includes a conical section 802 connected to a cylindrical section 804. Walls 804*a*, 804*b* of the cylindrical section 804 form a groove 806 around a perimeter of an open end of the nose cone 800. The groove 806 corresponds to the shape of the split tube 100 of the explosive structure and is sized to accommodate a thickness of the walls of the split tube 100. The groove 806 can be sized to hold the nose cone 800 and split tube 100 together via compression fit. As shown in FIGS. 8A and 8B, the nose cone 806 comprises holes 804*c* in the sides, which can receive a projectile fastener to hold the projectile 206 in a desired position. Tabs, hooks, or other protrusions 808 on an interior of the nose cone 800 also can be included to attach a projectile fastener. Additionally, the nose cone can include a hook 820 at an apex of the conical section 802 of the nose cone 800. A projectile 206 having an end attached to the hook 820 will be retained in a center of the nose cone 800, thereby suspending the projectile 206 in a longitudinal center of a split tube 100 of an explosive structure connected to the nose cone 800.

A nose cone 800 may be utilized on one or both ends of a split tube 100 of an explosive structure. Additionally, the conical section 802 of the nose cone 800 may be blunted to any desired degree by reducing the length of the conical section 802. The conical section 802 may be reduced in length or reduced to a spherical section. The conical section 802 also may be replaced with a linear section more in the form of an end cap than a nose cone.

If an end piece, such as a nose cone 800, end cap, or tube connector 400, 500, 600, is utilized, the projectile connectors of the projectile 206 may be attached to the end piece on one end of the split tube 100 and/or the end piece on the other end of the split tube 100. The end pieces are configured with a hole, indent, design, tab, hook, or other suitable connector recess to accept the tube connectors. Twisting the end piece around the ends of the split tube 100 of the explosive structure moves the connector recess around the split tube 100 to control a height of the projectile 206 above the explosive 204. The projectile connectors may be connected to the end pieces via any suitable manner. For example, the end pieces may include a cross-member on an interior diameter or other protrusion inside or outside the end pieces, and the projectile connector may be attached to these items.

Although described previously as using a fastener cord between the projectile connector and the projectile 206, the fastener cord may be omitted or supplied in the end piece. For example, the hooks or other projectile connectors may be connected directly to the projectile 206 and/or the end piece or connectors in the end piece.

Connecting the projectile 206 to the nose cone, end cap, tube connector, and/or other end piece can increase the explosive structure's integrity to hold the various components in place. For example, a projectile 206 connected to a nose cone on one end of a split tube 100 and an end cap on another end of the split tube 100 will hold the nose cap and the end cap on the ends of the split tube 100.

The end caps and connectors described herein may retain an inserted split tube via compression fit.

Figure 9:
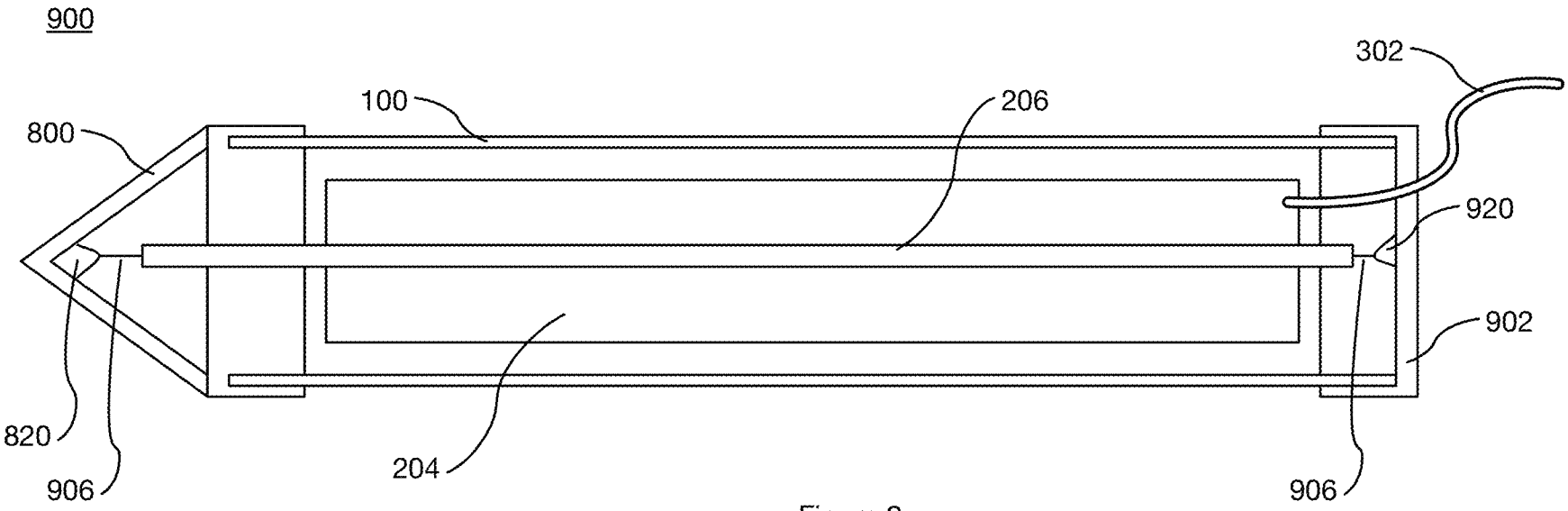
FIG. 9 is a cross-sectional view of an explosive structure comprising a suspended projectile.

FIG. 9 is a cross-sectional view of an explosive structure 900 comprising a suspended projectile 206. As shown in FIG. 9, the explosive structure 900 comprises an explosive 204 disposed on an interior of a split tube 100. A nose cone 800 is provided on one end of the split tube 100, and an end cap 902 is provided an opposite end of the split tube 100. An explosive 204 is suspended between the nose cone 800 and the end cap 902 via hooks 820 and 920 in the nose cone 800 and the end cap 902, respectively. Connecting cords or devices 906 can be utilized to connect the projectile 206 to the hooks 820, 920. The projectile 206 is suspended within the tubular structure of the split tube 100. Any suitable projectile 206 may be utilized as the suspended projectile 206. One example of a suspended projectile 206 is a chain having a desired length.

Suspending the projectile 206 above the explosive 204 provides different dynamics to the explosive effect compared to placing the projectile 206 in contact with, or closer to, the explosive 204. For example, more explosive 204 may be used in the suspended configuration without the explosion degrading the projectile 206 too significantly. The increased explosive 204 propels the projectile 206 and/or the projectile 206 fragments with increased force, which increases the effect on target. Using more explosive 204 when the projectile 206 is positioned in contact with the explosion can increase fragmentation of the projectile 206, which can decrease the effect on the target. The amount of explosive 204, the position/configuration of the projectile 206, and the type of projectile 206 can be selected to provide a desired effect on target.

An exemplary pigtail 302, as described herein, is illustrated in FIG. 9 coupled to the explosive 204.

In operation, detonation of the explosive 204 on the split tube 100 propels the projectile 206 away from the explosive 204. In this manner, the direction of the projectile 206 and projectile 206 fragments can be controlled in a desired direction, such as toward a desired obstacle or object.

For example, an explosive structure can be pushed under or into an obstacle, such as concertina wire or barbed wire, with the projectile 206 facing the obstacle. Detonation of the explosive 204 propels the projectile 206 and/or projectile 206 fragments into the obstacle, thereby destroying or moving at least a portion of the obstacle to allow passage.

The projectile 206 can comprise any suitable material and can be tailored to operate with a desired type and amount of explosive 204. As depicted in FIG. 2, the projectile 206 can comprise a metallic band that is continuous along its length and having a desired width across the transverse direction of the split tube 100. A single projectile 206 or multiple projectiles 206 can be used to produce the desired effect.

Other suitable projectile materials include chain, metal pipe or tubing, steel shrapnel, wire cable, sprung metal, wire mesh, wire weave, weaved metal cable, sheet metal, metal rods, high-density non-metallic materials, rock, sand, or any other suitable material that provides a desired effect when propelled by the explosive 204 and/or when fragmented and propelled by the explosive 204.

The projectile 206 can be fragmentable in conjunction with a type and/or amount of explosive 204. A fragmentable projectile 206 produces shrapnel directed at the target. The projectile 206 can be chosen to remain substantially intact or to produce large fragments in conjunction with a type and/or amount of explosive 204. For example, a long projectile 206, such as chain, that remains substantially intact may cut through an obstacle, such as concertina wire or barbed wire. This type of projectile 206 also may grab the obstacle, such as concertina wire or barbed wire, and move the obstacle from its position.

The projectile 206 may be chosen to be fragmentable, partially fragmentable, or not fragmentable. For example, when clearing concertina wire, it may be desirable for the projectile 206 to remain intact or to only fragment into longer sections. Such longer sections may be twelve inches or longer, although the desired length may be longer or shorter depending on the target and the desired effect. In this manner, the explosive 204 propels the projectile 206 (in whole or in sections) toward the object, the lengths of projectile 206 "grab" the object, and the momentum of the projectile 206 carries the object away from the object's initial location. Alternatively or additionally, the longer sections of projectile 206 may tear through an object as it passes therethrough.

One particular projectile 206 is sprung metal. The sprung metal's natural shape is a rolled, tubular configuration having a length in a longitudinal direction. The sprung metal can be compressed into a rolled, small cylindrical shape and held in position with a pin. Removal of the pin allows the spung metal to return to the rolled, tubular configuration. The rolled, tubular configuration is useful as a projectile 206 with the explosive structures described herein. The sprung metal may be transported easily in the compressed, cylindrical shape and then deployed when preparing an explosive structure, for example, when near the target.

The projectile 206 may attached to the explosive structure via any suitable manner. For example, the projectile 206 may be taped, glued, or otherwise attached to the split tube 100 or to the explosive 204 that is attached to the split tube 100. Alternatively, the projectile 206 may be laid on the split tube 100 or the explosive 204 as desired. As described previously, the projectile 206 may be positioned relative to the explosive 204 such that the projectile 206 does not touch the split tube 100 or the explosive 204 along its entire length. Additionally, the configuration of an explosive structure can position the projectile 206 between the split tube 100 and the explosive 204. In this configuration, the explosive 204 will propel the projectile 206 through the split tube 100 toward the target.

The explosive structure described herein is useful to clear infantry-type obstacles, such as concertina wire and mine fields, using the operation described previously. The explosive structure described herein also has many other uses. For example, the structure can be placed on the ground facing up or facing in a desired direction and used as an anti-personnel mine, similarly to a "claymore" mine. For an anti-personnel mine, a ball shot type of projectile 206 may be poured into the open side of the split tube 100 and held in place by the curvature of the split tube 100. Sand or rock also are useful projectiles for the anti-personnel mine configuration. The structure can be detonated manually or via a trip mechanism. In other uses, the structure can be placed vertically to breach/clear a door, wall, vegetation, or other object. The explosive structure can be placed under, in, on, or over an object to be breached/destroyed, such as a door, wall, concertina wire, mine field, or other structure.

The amount and type of explosive 204 can be chosen to provide the desired effect when combined with the selected projectile 206. More explosive 204 may produce more fragmentation and/or projectile 206 speed. Less explosive 204 may produce lesser fragmentation while still generating enough projectile 206 speed to provide the desired effect on the target.

The explosive 204 can be any suitable type of explosive 204, and generally an explosive that is flexible to accommodate the rolling and unrolling of the explosive structure. For example, the explosive 204 can be sheet explosive; detonation cord; malleable explosives such as RDX, C4, plastique, gel, or other malleable explosive, or any suitable explosive.

The explosive structures and methods to deploy explosive structures described herein can provide many advantages. The split tube 100 described herein is rigid in the linear, deployed state 100*c*. Accordingly, the deployed explosive structure is a rigid structure that can promote faster and more accurate placement of the explosives 204/projectiles 206, can hold the explosives 204/projectiles 206 in a desired position, and can facilitate reaching the explosives 204/projectiles 206 away from the operator. Additionally, deploying the explosive structure is an easier task as the split tube 100 can be fed out from the rolled state directly into the linear state.

Furthermore, the split tube 100 can be self-deploying. Once a portion of a bistable split tube 100 is moved from the rolled, undeployed position, the remainder of the split tube 100 will unroll to extend the split tube 100 to the linear, deployed position. Such deployment can be almost instantaneous, reducing the time to deploy the explosive structure and reducing the time on target (or otherwise in the dangerous situation).

The explosive structures and methods described herein provide a structure that can be assembled in a rigid state (the linear, deployed state 100*c* of the tape), transitioned to a reduced size for storage or transportation (the rolled, undeployed state 100*a* of the tape), and then transitioned again to the rigid state (the linear, deployed state 100*c* of the tape) for deployment of the explosive 204 and projectile 206. The split tube 100 described herein can allow easier assembly of the explosive structure in the rigid state, faster and easier rolling of the explosive structure for storage and transportation, and faster and easier deployment of the explosive structure to the rigid state for deployment in the field.

The explosive structures and methods described herein also can reduce or eliminate damage to the explosive 204 and projectile 206 when moving the explosive structure from the rigid state, to the stored state, and back to the rigid state. The design of the split tube 100 reduces force applied to the attached explosive 204 during transitions as the split tube 100 absorbs certain transverse forces by transitioning from a curved profile when deployed (linear) to a flat profile when undeployed (rolled), and when transitioning from the flat profile when undeployed (rolled) to the curved profile when deployed (linear).

In another example, the explosive structures described herein may comprise a foldable support structure in place of the split tube. The foldable support structure can comprise multiple foldable sections connected by hinges, whereby the foldable sections can fold inwardly via the hinges to reduce the size of the support structure and unfold outwardly via the hinges to create a desired length of support structure. The foldable sections can lock in the unfolded position to create a sturdy support structure across the length of the unfolded support structure. For example, hinges connecting the foldable sections can lock in the unfolded position to lock the foldable sections in the unfolded position. Alternatively, or additionally, the foldable sections can have overlapping ends that overlap and engage in the unfolded position to hold the unfolded structure in position. In another example, sections of split tube 100 can be used as the hinges attaching the foldable sections. The split tube hinges will self-deploy to the linear position to unfold the foldable sections and to hold the foldable sections in a linear state. As the split tube 100 is rigid in the deployed state, the split tube hinges provide a rigid connection for the unfolded sections. The foldable support structure may be formed from any suitable materials, such as, for example, plastic, wood, fiberglass, composites, or any other suitable material.

The components and systems described herein can be formed of any suitable material. A person having ordinary skill in the art and the benefit of this disclosure will understand that multiple options exist for manufacturing the components and structures described herein.

The example systems, methods, and components described in the embodiments presented previously are illustrative, and, in alternative embodiments, certain components can be combined in a different order, omitted entirely, and/or combined between different example embodiments, and/or certain additional components can be added, without departing from the scope and spirit of various embodiments. Accordingly, such alternative embodiments are included in the scope of the following claims, which are to be accorded the broadest interpretation so as to encompass such alternate embodiments.

Although specific embodiments have been described above in detail, the description is merely for purposes of illustration. It should be appreciated, therefore, that many aspects described above are not intended as required or essential elements unless explicitly stated otherwise. Modifications of, and equivalent components or acts corresponding to, the disclosed aspects of the example embodiments, in addition to those described above, can be made by a person of ordinary skill in the art, having the benefit of this disclosure, without departing from the spirit and scope of the invention defined in the following claims, the scope of which is to be accorded the broadest interpretation so as to encompass such modifications and equivalent structures.

What is claimed is:

1. An explosive structure, comprising:

a split tube having a length, the split tube being rollable into a roll in an undeployed state and deployable into a straight form along its length in a deployed state;

a nose cone coupled to one end of the split tube;

an explosive coupled to at least a portion of the length of the split tube; and a projectile disposed relative to the explosive.

2. The explosive structure according to claim 1, wherein the projectile is disposed relative to the explosive by being disposed adjacent to the explosive.

3. The explosive structure according to claim 1, wherein projectile is disposed relative to the explosive by being disposed on a side of the split tube that is opposite to the side on which the explosive is coupled.

4. The explosive structure according to claim 1, wherein the projectile is disposed relative to the explosive by being suspended inside the split tube without contacting the explosive.

5. The explosive structure according to claim 1, wherein the projectile is fragmentable.

6. The explosive structure according to claim 1, wherein the projectile comprises chain, metallic band, sprung metal, metal pipe, metal tubing, steel shrapnel, wire cable, wire mesh, wire weave, weaved metal cable, sheet metal, metal rods, high-density non-metallic material, or ball shot.

7. The explosive structure according to claim 1, the split tube comprising a bistable, self-deployable structural tape, the structural tape having a rolled, flat transverse profile in the undeployed state, and the structural tape having a linear, curved transverse profile in the deployed state, the structural tape being stable in the undeployed state and in the deployed state and being unstable when between states such that transitioning one end of the structural tape from the rolled shape to the linear shape places the tape in an unstable state causing the tape to self-deploy to the deployed state.

8. The explosive structure according to claim 1, wherein the split tube comprises two sections, the explosive structure further comprising a connector that couples the two sections of split tube together.

9. The explosive structure according to claim 1, wherein the split tube comprises a bistable structural tape comprising an undeployed state and a deployed state, the structural tape having a rolled, flat transverse profile in the undeployed state, and the structural tape having a linear, curved transverse profile in the deployed state.

10. The explosive structure according to claim 9, the structural tape further being stable in the undeployed state and in the deployed state and being unstable when between states such that transitioning one end of the tape from the rolled shape to the linear shape places the tape in an unstable state causing the tape to self-deploy to the deployed state.

11. The explosive structure according to claim 1, wherein the split tube is a metallic tape.

12. The explosive structure according to claim 1, wherein the explosive structure can be compacted into the undeployed state of the split tube and extended into the deployed state of the split tube.

13. The explosive structure according to claim 1, further comprising an adhesive that couples the explosive to the split tube.

14. The explosive structure according to claim 13, wherein the adhesive is an adhesive tape, a two-sided adhesive tape, or a spray adhesive.

15. The explosive structure according to claim 1, further comprising an adhesive member coupled to the explosive structure to connect the explosive structure to another structure.

16. The explosive structure according to claim 1, wherein the explosive comprises a cord explosive.

17. The explosive structure according to claim 1, wherein the explosive comprises a sheet explosive.

18. The explosive structure according to claim 1, wherein the explosive is disposed on a convex side of the split tube when the split tube is in the deployed state.

19. The explosive structure according to claim 1, wherein the explosive is disposed on a concave side of the split tube when the split tube is in the deployed state.

20. The explosive structure according to claim 1, wherein a rolled profile of the split tube in the undeployed state comprises a flattened roll configuration.

21. A method to support an explosive and a projectile along a linear structure for transportation and deployment, comprising:

providing a bistable, self-deployable structural tape in an undeployed state, the structural tape comprising the undeployed state and a deployed state, the structural tape having a rolled, flat transverse profile in the undeployed state, and the structural tape having a linear, curved transverse profile in the deployed state, the structural tape being stable in the undeployed state and in the deployed state and being unstable when between states such that transitioning one end of the tape from the rolled shape to the linear shape places the tape in an unstable state causing the tape to self-deploy to the deployed state;

deploying the structural tape into the deployed state;

disposing an explosive lengthwise along the deployed structural tape;

coupling a nose cone to one end of the structural tape; and disposing a projectile lengthwise along the deployed structural tape and relative to the explosive.

22. The method according to claim 21, further comprising rolling the structural tape, the explosive, and the projectile into the undeployed state of the structural tape.

* * * * *